US005921701A

United States Patent [19]

Clayton

[11] Patent Number: 5,921,701

[45] Date of Patent: Jul. 13, 1999

[54] TRAFFIC INTERCHANGE

[76] Inventor: Robert F. Clayton, P.O. Box 5213, Largo, Fla. 33779-5213

[21] Appl. No.: 08/882,471

[22] Filed: Jun. 25, 1997

[51] Int. Cl.[6] ..... E01C 1/00

[52] U.S. Cl. ..... 404/1

[58] Field of Search ..... 404/1

[56] References Cited

U.S. PATENT DOCUMENTS

| | | | |
|---|---|---|---|
| 1,515,251 | 11/1924 | Graves | 404/1 |
| 1,543,080 | 6/1925 | Graves | 404/1 |
| 4,592,673 | 6/1986 | Lee | 404/1 |

FOREIGN PATENT DOCUMENTS

| | | | |
|---|---|---|---|
| 1243585 | 9/1960 | France | 404/1 |
| 1523478 | 3/1968 | France | 404/1 |
| 666563 | 9/1964 | Italy | 404/1 |
| 349637 | 10/1958 | Switzerland | 404/1 |

OTHER PUBLICATIONS

"Overhead Turnway," Architectural Forum, p. 48, Jul. 1946.

*Primary Examiner*—Thomas B. Will
*Assistant Examiner*—Gary S. Hartmann
*Attorney, Agent, or Firm*—Joseph C. Mason, Jr.; Dennis G. LaPointe

[57] ABSTRACT

An interchange for improving vehicular traffic flow through an intersection of surface streets includes a cross-shaped bridge supported over the intersection at a height to allow through traffic to proceed underneath. Crossed arms of the bridge are mutually aligned with the intersecting surface streets and carry four turning lanes each having an entrance end on one arm and an exit end on an adjacent arm for turning traffic arriving at the entrance end through a center-turning 90° curve before leaving the exit end. Four up-ramps, one aligned with the entrance end of each turning lane, convey onto the bridge left-turning traffic from a respective surface street, and four down-ramps, one aligned with the exit end of each turning lane and located adjacent to an up-ramp, convey traffic proceeding along a turning lane back to ground level for merging with surface street through traffic proceeding through the intersection.

14 Claims, 6 Drawing Sheets

TRAFFIC INTERCHANGE

BACKGROUND OF THE INVENTION

1. Field of the Invention

This invention relates to traffic interchanges and, more particularly, to a two-level interchange for improving the traffic flow through an intersection of surface streets. The structure directs left-turning traffic onto a relatively small center-turning overpass so as not to interfere with through-traffic.

2. Description of Related Art

Vehicular traffic on many city streets has increased to the point that a single level interchange cannot effectively handle the volume. A conventional 4-way intersection, such as the 3-lane intersection schematically depicted in FIG. 8, has two eastbound lanes 1 and 2, two westbound lanes 3 and 4, two southbound lanes 5 and 6, two northbound lanes 7 and 8, and for each direction one of the two lanes carries left-turning traffic, as indicated by the curved arrows in lanes 2, 4, 6 and 8. Thus, if the right turn paths, from eastbound lane 1 into southbound lane 3, for example, are ignored, the intersection has eight paths through it, any single one of which conflicts with five other paths, while the remaining two paths are mutually conflicting so traffic paths can proceed simultaneously on only two paths. Accordingly, the traffic light at the intersection must cycle through four phases in order to provide an orderly flow of traffic: left-turning cross-traffic; cross traffic, left-turning through traffic and, finally, through traffic. Typically, the traffic light is controlled by a four-phase timing clock set for 15 seconds left-turn; 60 seconds East/West through traffic; 15 seconds left-turn; and 50 seconds North/South through-traffic (15:60:15:50). Since for every phase the red lights are on longer than the green, the intersection will, in most instances, jam in heavy traffic flow.

Multi-level street crossing interchanges which permit continuous traffic flow while common on interstate highways, are impractical for use in a crowded city environment. They usually include large radius cloverleaf turns covering a large land area, and typically also include traffic lanes stacked up on three or more grade levels. The cost of land acquisition to build such an interchange for a busy street intersection would be prohibitive. Moreover, for aesthetic reasons the intersection should not have more than two grade levels.

An example of a typical large interstate intersection is illustrated in U.S. Pat. No. 3,107,590 issued to A. O. Cedeno on Oct. 22, 1963. This intersection requires use of extensive adjoining property to accommodate its wide turning lanes.

U.S. Pat. No. 4,630,961 issued to H. Hellwig on Dec. 23, 1986, extends the teaching of this Cedeno patent, illustrating several attempts to compress Cedeno's design into urban situations. However, to do so required several city blocks and traversing six faces of two city blocks, turning 270 degrees right in order to turn 90 degrees left. If the route is not elevated, it fully corrals the properties of those two city blocks.

U.S. Pat. No. 2,946,267 issued to A. O. Cedeno on Jul. 26, 1960, is illustrative of a traffic intersection which can be used for city streets. However, more than two grade levels are required, all through lines must change in grade level at the street intersection, and right turns are unnatural because they must be initiated from the left side of the street.

A. O. Cedeno's U.S. Pat No. 2,949,067 dated Aug. 16, 1960 discloses a traffic intersection similar to that of U.S. Pat. No. 2,946,267, but provides for left turns from the left side of the street. However, through traffic in the intersection is reversed for the normal flow of traffic.

U.S. Pat. No. 5,049,000 issued to F. D. Mier et al on Sep. 17, 1991, discloses a continuous flow intersection of first and second streets having intersecting through lanes at two grade levels, one at ground elevation and the other either above or below ground. Right turn lanes are all located at grade level, and left turn lanes may originate from the left or right side of each street and cross over to eventually be on the left side of advancing traffic prior to reaching the intersection. Each left turn lane then curves through the intersection to enable traffic to merge with intersecting traffic from a right lane.

Continuous flow intersections are expensive and lend themselves to high speed applications; accordingly, they can only be justified in expensive Federal highway projects. They do not serve local traffic needs.

SUMMARY OF THE INVENTION

It is an object of the present invention to provide a surface street interchange which utilizes only two levels and which will occupy a minimum area.

Another object of the invention is to provide a two-level interchange for intersecting surface streets constructed of standardized, pre-fabricated component parts to reduce the cost of design and construction.

Another object is to provide a traffic interchange which may be installed on a normal city street right of way with virtually no new land acquisition.

Another object of the invention is to provide an interrupted flow surface street interchange controlled by traffic lights which reduces the red light duration and optimizes traffic flow through the intersection.

Another object of the invention is to provide a surface street interchange which does not isolate traffic from surrounding retail establishments that depend on the traffic, so as to preserve adjacent land values and the tenant's investments in sign and store identities.

Yet another object of the invention is to provide a surface street exchange that is amenable to the use of modern "smart" technologies to achieve optimization of intersection traffic flow.

According to the present invention, an overpass positioned at the intersection of two surface streets separates onto separate levels traffic crossing the opposing traffic stream from traffic proceeding through the intersection. The overpass is in the form of a cross-shaped bridge supported over the center of the intersection and accessed by ramps which enables center-turning of left-turning traffic without interfering with through traffic. If necessary for aesthetic reasons, the interchange for left-turning traffic alternatively may be an underpass built below ground level.

The center-turning overpass of the invention groups the traffic paths into path-pairs, each of which is rotationally-symmetric and non-conflicting, enabling one pair on each level to proceed simultaneously, for a total of four simultaneous paths, which, in turn, allows the use of a two-phase timing clock for controlling the traffic light. This simpler clock is able to balance the red and green periods of the traffic light, the durations of which can be varied throughout the day to meet the requirements of the traffic pattern. With fewer constraints on the light timing, the center-turning overpass optimizes traffic flow through the intersection and provides better traffic movement of the adjoining network of streets. The overpass allows limited turning of ground level traffic, too, including U-turns, to enable turning traffic to reach corner properties.

The overpass may take the form of a generally cross-shaped bridge span, the arrangement of which leaves an unused space under the center in which to locate support for the bridge, allowing an economical bridge with the lowest possible deck height. Alternatively, the bridge may be a free-span design, at the expense, however, of being slightly taller and somewhat more costly to fabricate. A suspension bridge is also theoretically possible.

BRIEF DESCRIPTION OF THE DRAWINGS

Other objects, features and advantages of the invention will become apparent, and its construction and operation better understood, from the following detailed description when read with reference to the accompanying drawings, in which.

DESCRIPTION OF THE ILLUSTRATED EMBODIMENTS

Figure 1:
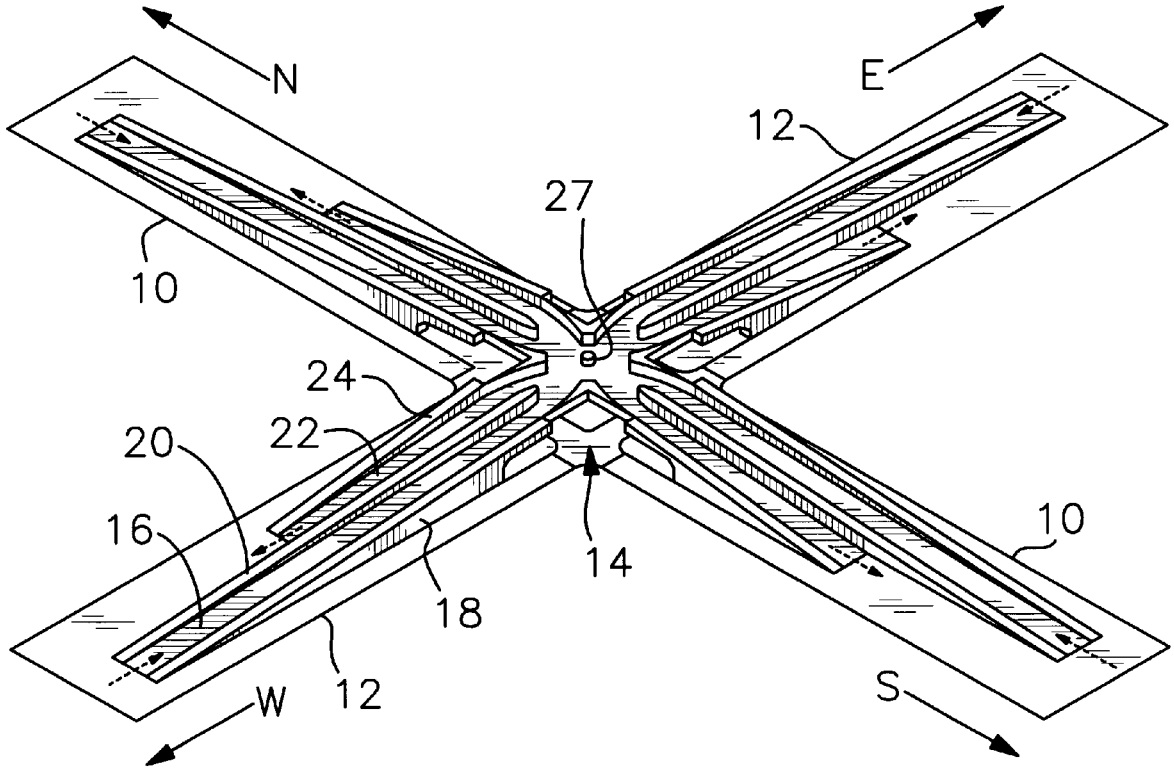
FIG. 1 is a perspective view of a traffic interchange constructed in accordance with the present invention.
Figure 2:
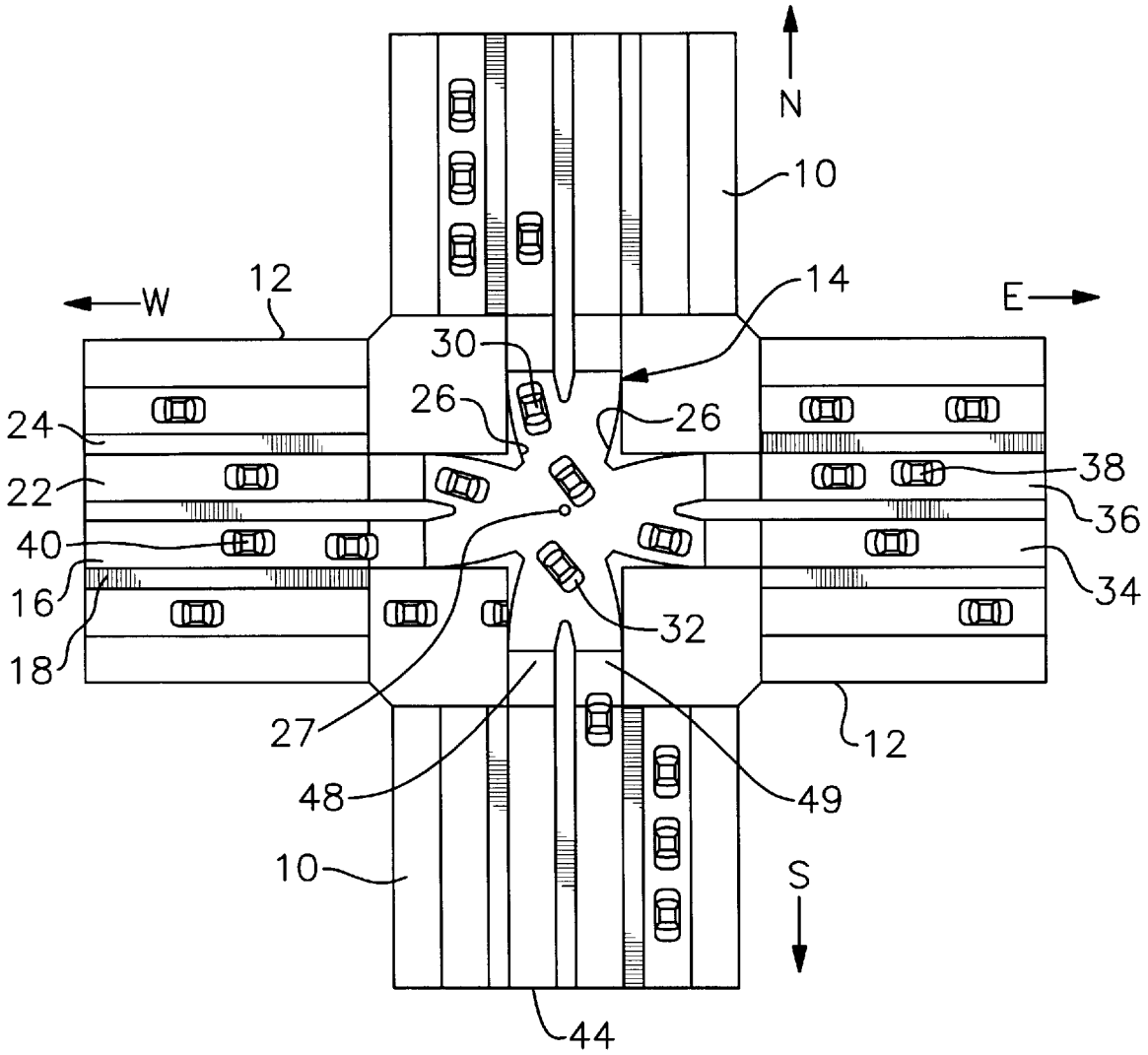
FIG. 2 is a plan view of the central portion of the interchange shown in FIG. 1.
Figure 3:
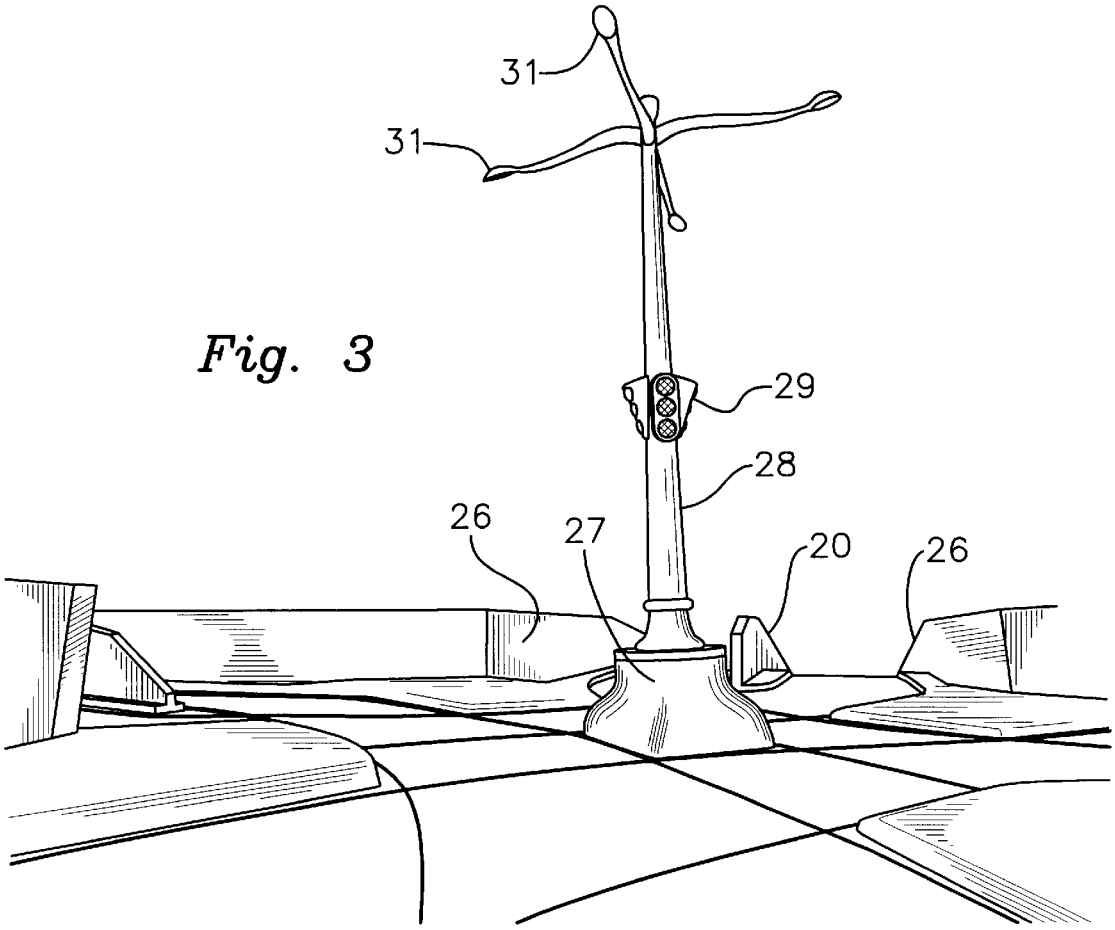
FIG. 3 is an enlarged pictorial view of the central portion of the interchange shown in FIG. 1.

Referring first to FIGS. 1, 2 and 3, the interchange of this invention is shown at the intersection of two ground level streets 10 and 12 running North-South and East-West, respectively, each having five lanes in this embodiment, but may have six to eight lanes. Typically, a 5-lane intersection has two through-traffic lanes in each direction at opposite sides of a lane for left-turning traffic. In accordance with this invention, through traffic flows through the intersection at grade or street level, and left-turning traffic approaching the intersection, from whatever direction, is directed onto an overpass 14 supported over the center of the intersection at a second level sufficiently high to allow street-level through traffic to proceed beneath it. The interchange, including ramps for carrying traffic to the overpass 14, is constructed totally within the normal confines of a street intersection so as to minimize or often eliminate additional land acquisition for right of way.

The overpass 14 is a simple cross-shaped bridge, preferably constructed of steel, having crossed arms mutually aligned with streets 10 and 12. Allowing fifteen to seventeen feet of clearance for street level traffic, the structure typically is about twenty-four feet high, the equivalent of a typical two-story house. Each arm of the cross-shaped bridge spans at least one and typically several standard 12-foot wide traffic lanes plus perhaps a 4-foot bicycle lane (not shown), plus a 24-foot wide clear space (not shown) for a pedestrian sidewalk and driver visibility. Each arm is divided by a guardrail into two lanes of equal width, one joined to an up-ramp and the other joined to a down-ramp, to be described.

As the connection of the ramps to an arm of the cross-shaped bridge is the same for all four, only one, that for left-turning traffic approaching from the West, will be described in detail. As seen in FIG. 1, left-turning traffic approaching from the West enters the street-level end of an inclined ramp 16, which may be packed earth paved over with asphalt and held in place with retaining walls 18 and 20 made, for example, of heavy corrugated steel sheet piles. The piles may be cut off three to four feet above the road surface so as to also function as a guardrail for ramp 16 and, as will be seen, also for one side of an adjacent down-ramp. In order to rise from ground level to the approximately 17-foot height of overpass 14 with a preferred slope of eight percent, the ramp is about 225 feet long. Steeper slopes, with attendant shortening and reduction in building cost, are acceptable and indeed sometimes may be advantageous, in that the ramp serves to brake the arriving traffic, which may be moving at 30 miles per hour or more, to 15 to 20 miles per hour before it makes the left turn on the overpass 14.

The inner end of retaining wall 20 divides the associated overpass arm into two lanes; wall 20 also serves as the inner retaining wall of an adjacent down ramp 22, the opposite side of which is defined by a retaining wall/guardrail 24. The down ramp may be steeper, and thus shorter, than the up-ramp, providing the advantage of allowing more room for the exiting traffic to merge into the through traffic.

As seen in FIG. 2 and 3, the top of the cross-shaped bridge has four turning lanes each of which may have a standard 12-foot or an allowable 11-foot width. The turning radius of each lane is in excess of fifty feet, sufficient to allow space for a substantial central barrier or pylon 27, which may be formed of reinforced concrete, to which is attached a lamp post 28 for traffic lights 29 and street lights 31. Adequate lane margins are provided with suitable inwardly extending curbing 26 to prevent scraping on walls, the barrier or passing cars. Each lane directs traffic arriving on one arm through a 90-degrees turn onto an adjacent arm.

In the FIG. 2 "snapshot" of the intersection, the traffic light controlling ground level traffic (not shown) is "green" for traffic moving East and West on street 12 and "red" for North/South traffic on street 10, and the pole-mounted traffic light 29 controlling turning traffic on the overpass level is "green" for traffic entering up ramps from North and South, represented by vehicles 30 and 32, respectively, allowing both to turn left and proceed along a respective lane without interfering with one another and to enter Eastbound and Westbound down ramps 34 and 22, respectively. The light is "red" for traffic entering up ramp 36 from the East and up-ramp 16 from the West, represented by vehicles 38 and 40, respectively. Thus, depending on the relative timing of the upper and lower level traffic lights, vehicle 30 (for example) may turn left from the stopped Southbound traffic on street 10, enter the up-ramp, turn left on the overpass 14, exit from down-ramp 34 and merge with the moving Eastbound traffic on street 12. If, during the time required for turning traffic to traverse the overpass the lower level traffic light has cycled, the vehicle will be able to enter an "empty" Eastbound lane.

When the upper level traffic light next cycles, traffic entering up-ramps from the North and South is stopped and the traffic light 29 is "green" for traffic entering up-ramp 16 from the West and up-ramp 36 from the East, allowing both to turn left without interfering with one another, by each keeping to the left of the barrier 27, and to enter down-ramps 42 and 44, respectively.

Thus, the center-turning overpass groups turning traffic into two path-pairs, each of which is rotationally symmetric and non-conflicting, enabling traffic on one pair to proceed simultaneously, for a total of two simultaneous paths. The intersecting surface streets also provide two path-pairs, namely, North and South lanes on street 10 and East and West lanes on street 12, each of which is rotationally symmetric and non-conflicting, enabling one pair to proceed simultaneously. Thus, it is seen that by reason of the center-turning overpass, the intersection has a total of four simultaneous paths, two on each level. This grouping of traffic paths allows the use of a two-phase timing clock on each level for controlling the respective traffic lights. The simpler clocks are able to balance the red and green periods of their respective traffic lights, independently of each other, the duration of each of which can be varied throughout the day to meet the demands of changing traffic patterns on each level. For example, video cameras watching the traffic, and computers analyzing the images, can detect the correct point to change the traffic light for optimum traffic flow. The conventional intersection cannot be upgraded through the use of such "smart" technology because every path through the intersection conflicts with five other paths, thus requiring that the equipment arbitrate six different factions; only two seconds per cycle might be saved after resolving all the constraints. By contrast, the present center-turning overpass equipped with cameras and computers, because it only has to arbitrate East-West versus North-South, might save twenty seconds of wait time per cycle; for 50,000 cars through the interchange per day over a 30-year life the savings would be tremendous. Thus, it is seen that the fewer constraints on the traffic light timing achievable by the center-turning overpass 14 enables optimization of traffic flow through the intersection unattainable with the conventional intersection. The ability to use two-phase traffic light cycles provides important advantages: it can reduce red light times by 75%; it allows flexible timing; it can significantly increase traffic capacity; and it can break up a "micro-jam" by increasing the green light interval before it becomes a major jam.

Figure 5:
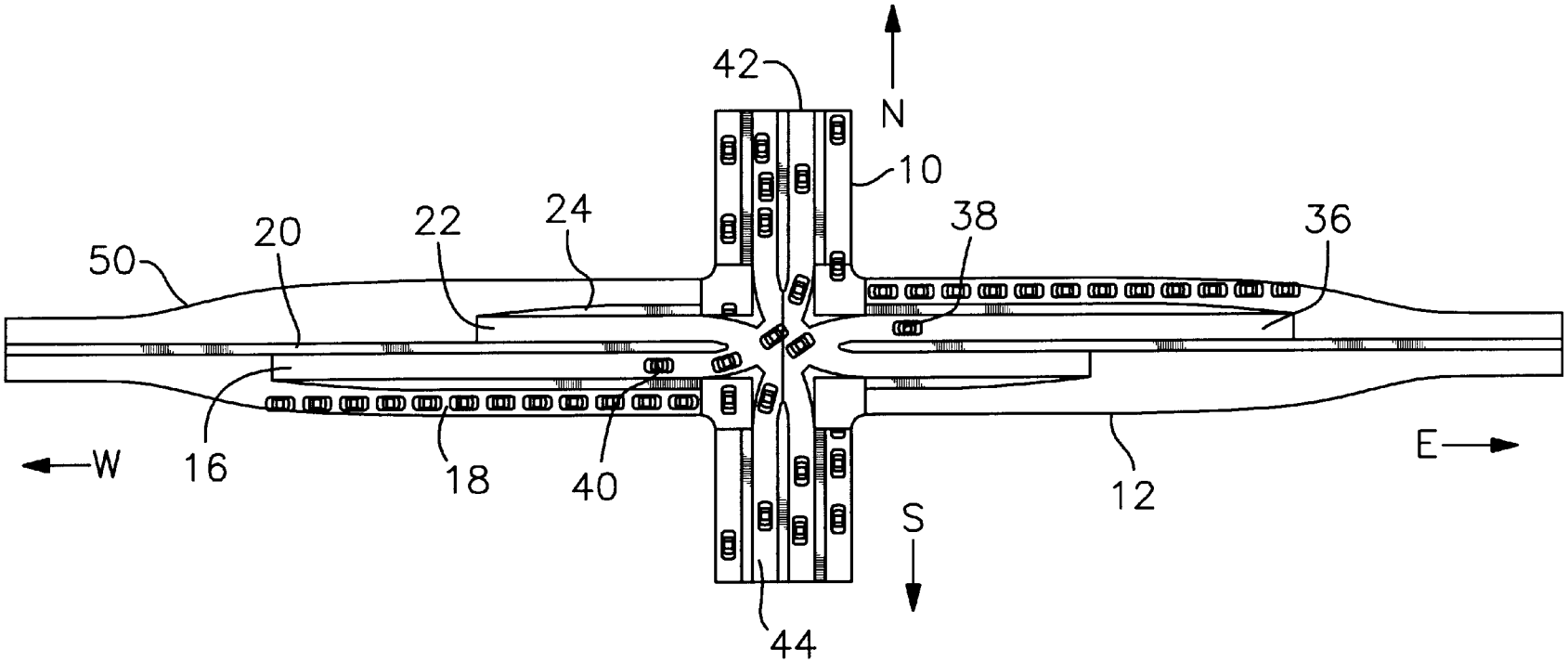
FIG. 5 is an expanded plan view of the interchange shown in FIG. 2.

The advantage of the down-ramps being shorter and steeper than the up-ramps is illustrated in FIG. 5, wherein the ground level traffic light is "green" for traffic moving North and South and "red" for East/West traffic, and the upper level traffic light 29 is "green" for traffic entering up-ramp 36 from the East and up-ramp 16 from the West, allowing both to turn left and enter respective down-ramps 42 and 44. When light 29 next cycles, traffic entering an up-ramp from the South is allowed to turn left to down-ramp 22, and it will be assumed that the ground level traffic light has also cycled to start the flow of East/West traffic on street 12, so there will be Westbound traffic moving along the retaining wall 24 of down-ramp 22. The down-ramp being shorter than the adjacent up ramp 16 provides more room for through traffic merging into the lane if the street narrows ahead as shown at 50. If the street does not narrow, then down-ramp traffic proceeds straight ahead and relies on through traffic to merge left, which is easier than it is for the down-ramp traffic to merge right, since traffic coming down the ramp has a blind spot on its right looking down the embankment.

Figure 4:
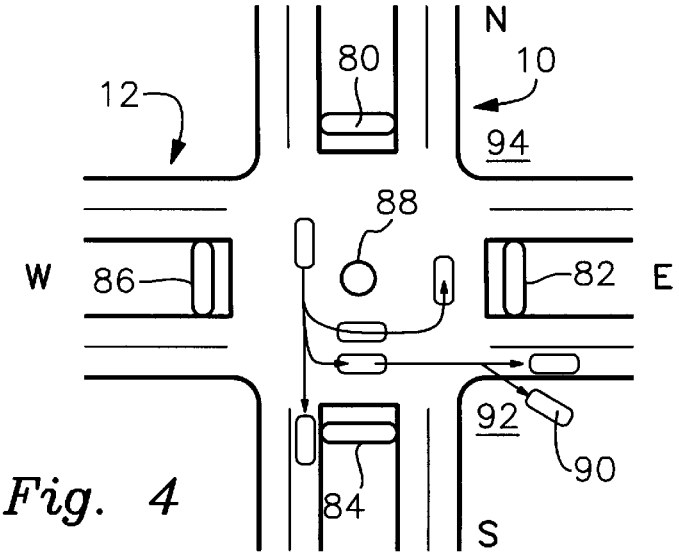
FIG. 4 is a plan view of the surface streets beneath the interchange shown in FIG. 1.

As will be seen in FIG. 4, in which the cross-shaped bridge has been removed to display the relationship of the bridge supports with the surface streets beneath the bridge, the overpass also allows limited turning of ground level traffic, including U-turns, to enable turning traffic to reach corner properties. In this case, the four arms of the bridge are supported by respective support members 80, 82, 84 and 86 and a central support member 88, all of which are positioned so as not to interfere with traffic flow through the intersection of streets 10 and 12. A south-bound vehicle 90 can turn left onto street 12 and, if desired, turn into a corner property 92, as represented by the new position 90' of the vehicle. Or, the vehicle can make a complete U-turn (after waiting for the light to change) into the position 90" and access to another corner property 94. This feature of the interchange is of particular advantage in the handling of emergency vehicles requiring access to corner properties, and overweight vehicles as well. Further, it allows individual lanes on the upper deck to shut down for maintenance with traffic detoured to turns on ground level.

Figure 6:
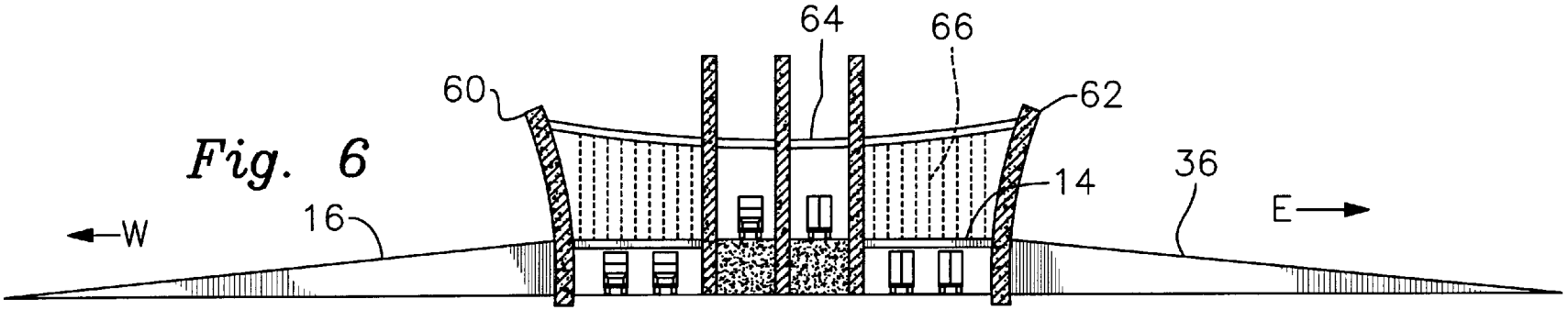
FIG. 6 is an elevation cross-sectional view of the interchange in which support for the overpass embodies suspension bridge design principles.

An alternative support for the cross-shaped bridge is the suspension bridge design schematically illustrated in FIG. 6, which includes towers 60 and 62 at the East and West ends of the deck of the overpass between which a pair of cables, one of which is visible at 64, extend. A multiplicity of smaller diameter cables 66 are secured to and depend from cable 64 and its companion cable, and at their lower ends are secured to and support the cross-shaped deck 14. The cross-shape of the bridge affords three support corridors crossing three more support corridors for a total of six intersecting lines of support; this much support makes it possible to design a relatively inexpensive suspension bridge. The structure is open, airy and soaring, and its cross-configuration is intrinsically stable in cross-winds.

Figure 7:
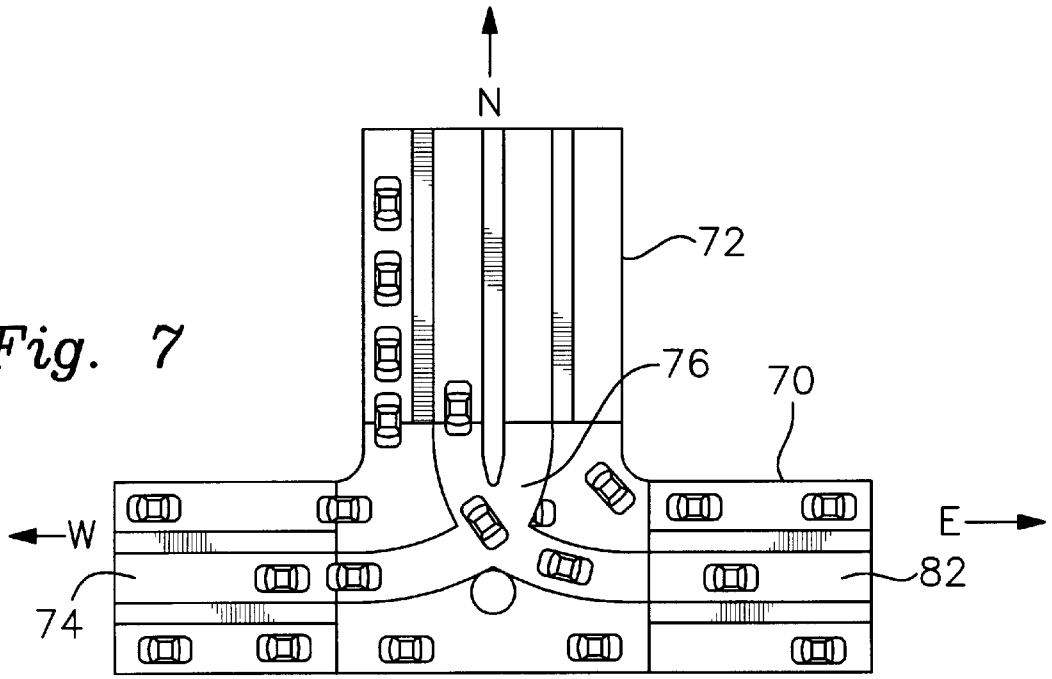
FIG. 7 is a plan view of an interchange constructed in accordance with the invention in use with a T-intersection of surface streets.
Figure 8:
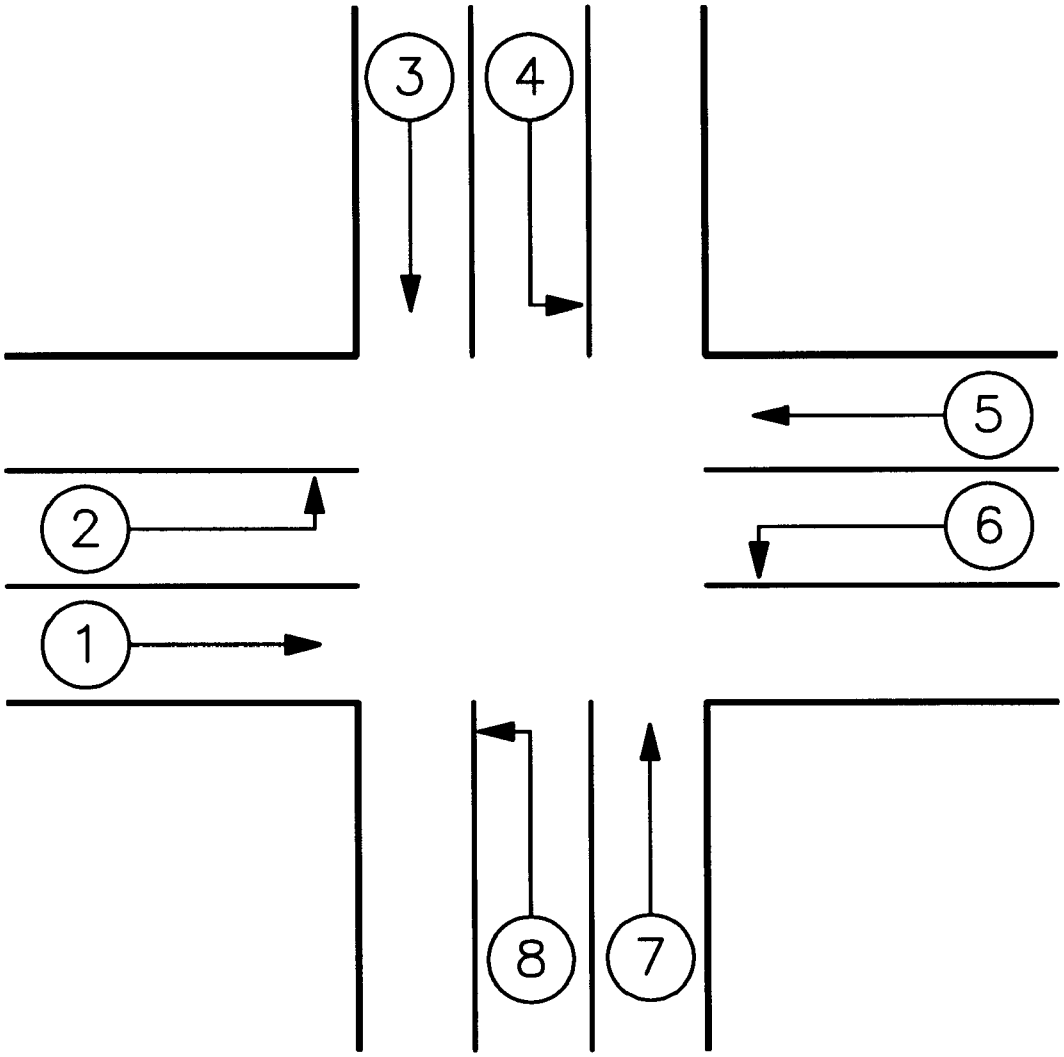
FIG. 8, previously referred to, is a schematic representation of a conventional 3-lane intersection.

The overpass design can be modified as shown in FIG. 7 for installation over a 3-way ground-level intersection of an East/West street 70 with a Northbound street 72. Control of ground level traffic, which includes right turns from the Westbound lane of street 70 onto street 72, and from the Southbound lane of street 72 onto the Westbound lane of street 70, might require only stop signs. Upper level traffic, that is, traffic proceeding from the West onto an up-ramp 74, and turning left at the center of the cross-shaped bridge structure 76 onto a Northbound down-ramp, and traffic proceeding from the North onto an up-ramp 80 and turning left on the bridge structure onto an Eastbound down-ramp 82, might also be controlled using only stop signs. Alternatively, the latter may be controlled by a demand-paged traffic light.

The center-turning overpass described above, however supported, can, without modification of the bridge, serve larger intersections having seven or eight lanes, for example. As shown in FIG. 2, overpass 14 is accommodated to a 6-lane intersection by supporting the cross-shaped bridge over the center of the intersection, as before, and simply inserting a horizontal spacer between a ramp and its respective turning lane, two of which are shown at 48 and 49, the length of which is determined by the number of through lanes that must be spanned. The horizontal spacer initially may have sufficient length and stiffness to span a worst case number of lanes, which then is cut to the length necessary for a lesser number of lanes; longer spans means thicker decking which, in turn, means taller ramps, so a spacer design for a worst case situation enables the ramps to be standardized. This standardization can result in significant cost savings in that standard pre-fabricated components can be installed in any intersection in the world having five or more lanes because the design applies equally well for left and right hand drives. Design and component standardization also results in cost savings in site and design engineering, materials purchases, fabrication and installation, and increased public acceptance. Currently, most conventional overpasses are custom engineered for every site, making them intimidating and confusing to drivers from outside the local area. Improved familiarity resulting from standardization will improve safety.

While the invention has been described as an above-grade overpass, if necessary for aesthetic reasons, its design principles may be embodied in an underpass built below ground level. Concentration of the structural elements at the center of the intersection allows the use of simple cut-and-cover construction, the least expensive solution for underground construction. The design can also be adapted or customized for intersections at oblique angles, although perpendicular intersections are preferred.

Although preferred embodiments of the invention have been described, it will now be evident to ones skilled in the art that certain modifications and changes can be made without departing from the spirit and scope of the invention. Accordingly, it is intended that the scope of the invention be determined by the appended claims and not by the herein disclosed examples.

What is claimed is:

1. An interchange for improving the flow of vehicular traffic through an intersection of first and second surface streets, including turning traffic that crosses traffic proceeding through the intersection at ground level, said interchange comprising:

an interchange having first and second levels located at a central area of said intersection for separating by level traffic proceeding through the intersection from said turning traffic, said second level comprising a bridge vertically spaced a predetermined distance from ground level and having thereon multiple turning lanes each having an entrance portion aligned with one of said first and second streets and an exit portion aligned with the other of said first and second streets;

multiple first ramps each for conveying from ground level to the entrance portion of a turning lane a respective stream of turning traffic; and multiple second ramps, each for conveying a respective stream of traffic from the exit portion of a turning lane to ground level for merging with such traffic as may be proceeding through the intersection on a respective surface street, wherein respective first and second ramps of each of said first and second streets are parallel to each other, and wherein said respective first and second ramps are adjacent to each other along opposing sides of a centerline of each of said first and second streets thereby sharing a common retaining wall between them.

2. An interchange as defined in claim 1, wherein the second level of said interchange is disposed below ground level, thereby limiting an excavation necessary to construct said second level to a central portion of said intersecting first and second surface streets.

3. An interchange as defined in claim 1, wherein the second level of said interchange is disposed above ground level.

4. An interchange as defined in claim 1, wherein said bridge is supported above the central area of the intersecting surface streets and is located between opposite outside flowthrough traffic lanes, has crossed arms mutually aligned with said intersecting first and second surface streets, and has four turning lanes thereon each for directing turning traffic arriving on one of said arms through a 90-degree turning curve for exit from an adjacent arm.

5. An interchange as defined in claim 4, wherein each turning lane is in part defined by a barrier disposed on said bridge at the center of said crossed arms for separating streams of traffic proceeding in opposite directions along opposing turning lanes.

6. An interchange as defined in claim 5, wherein the four turning lanes group traffic proceeding over said bridge into two path-pairs on said second level, each pair being rotationally-symmetric and non-conflicting, and wherein said intersecting streets group traffic on said streets into two path-pairs on said first level, each pair being rotationally-symmetric and non-conflicting, whereby the interchange has four simultaneous paths, two on each level, thereby allowing the use on each level of a two-phase timing clock for controlling a respective traffic light.

7. An interchange as defined in claim 6, further comprising a traffic light supported on said barrier and controlled by a two-phase timing clock for arbitrating traffic flow between the two path-pairs on said second level.

8. An interchange as defined in claim 4, wherein each arm of said bridge is connected to one of said first ramps and to a second ramp disposed adjacent to the said one first ramp, and wherein said second ramp is steeper than said one first ramp.

9. An interchange as defined in claim 1, wherein said first surface street makes a T-intersection with said second surface street, said second surface street being adapted to convey traffic through said intersection in both directions and turning traffic that crosses traffic proceeding through the intersection at ground level;

wherein said bridge has two turning lanes thereon located over the central area of said T-intersection, each having an entrance portion aligned with said second street and an exit portion aligned with said first street and which cross one another.

10. An interchange for improving the flow of vehicular traffic through an intersection of first and second surface streets, including turning traffic that crosses ground level traffic proceeding through the intersection, said interchange comprising:

a cross-shaped bridge supported over a central area of said intersection at a height sufficiently above ground level as to allow traffic on said surface streets to proceed thereunder, said bridge having thereon four turning lanes each having an entrance portion aligned with one of said first and second streets and an exit portion aligned with the other of said first and second streets, each turning lane for directing traffic arriving on its entrance portion through a substantially 90-degrees turning curve to its exit portion;

four up-ramps, one aligned with the entrance portion of each of said turning lanes, for conveying onto said bridge turning traffic from a respective surface street and thereby separating turning traffic from through traffic; and four down-ramps, one aligned with the exit portion of each turning lane and disposed adjacent an up-ramp for conveying back to ground level traffic which has traversed said turning lane for merging with traffic proceeding on a respective surface street through the intersection, wherein respective up-ramps and down-ramps of each of said first and second streets are parallel to each other, and wherein said respective up-ramps and down-ramps are adjacent to each other along opposing sides of a centerline of each of said first and second streets thereby sharing a common retaining wall between them.

11. An interchange as defined in claim 10, wherein said bridge has crossed arms mutually aligned with said first and second intersecting surface streets, and wherein each arm of said bridge aligns the entrance end of one turning lane with an up-ramp and aligns the exit end of a second turning lane with an adjacent down-ramp.

12. An interchange as defined in claim 11, wherein said down-ramps are steeper and shorter than said up-ramps for providing additional room for down-ramp traffic to merge with surface street traffic proceeding along the right side of the down-ramps.

13. An interchange as defined in claim 10, wherein each of said turning lanes is defined in part by a barrier disposed at the center of said cross-shaped bridge for separating streams of traffic proceeding in opposite directions along opposing turning lanes.

14. An interchange as defined in claim 10, wherein said bridge is dimensioned to span an x-lane intersection, where "x" is at least five, and said first and second intersecting surface streets each has more than "x" lanes, and wherein a horizontal spacer is inserted between each ramp and its respective turning lane, said spacer having a length determined by the number and width of through lanes in excess of "x" that must be spanned by said spacers.

* * * * *